US009669912B2

(12) United States Patent
Hesse

(10) Patent No.: US 9,669,912 B2
(45) Date of Patent: Jun. 6, 2017

(54) UNDERWATER WORKING SYSTEM AND METHOD FOR OPERATING AN UNDERWATER WORKING SYSTEM

(71) Applicant: ATLAS ELEKTRONIK GmbH, Bremen (DE)

(72) Inventor: Sven-Christian Hesse, Bremen (DE)

(73) Assignee: ATLAS ELEKTRONIK GmbH, Bremen (DE)

( * ) Notice: Subject to any disclaimer, the term of this patent is extended or adjusted under 35 U.S.C. 154(b) by 174 days.

(21) Appl. No.: 14/387,238

(22) PCT Filed: Feb. 13, 2013

(86) PCT No.: PCT/DE2013/100053
§ 371 (c)(1),
(2) Date: Sep. 23, 2014

(87) PCT Pub. No.: WO2013/143528
PCT Pub. Date: Oct. 3, 2013

(65) Prior Publication Data

US 2015/0046014 A1 Feb. 12, 2015

(30) Foreign Application Priority Data

Mar. 30, 2012 (DE) ..... 10 2012 006 565

(51) Int. Cl.
*G01C 22/00* (2006.01)
*B63G 8/00* (2006.01)
(Continued)

(52) U.S. Cl.
CPC ..... *B63G 8/001* (2013.01); *B63G 8/39* (2013.01); *B63G 8/42* (2013.01); *B63G 2008/004* (2013.01)

(58) Field of Classification Search
CPC ..... B63B 35/04; B63G 8/001; G01S 15/74; G06T 2207/10012; G06T 7/0075;
(Continued)

(56) References Cited

U.S. PATENT DOCUMENTS 5,396,859 A * 3/1995 Hillenbrand ..... B63G 8/001 114/312
5,838,636 A * 11/1998 Ashford ..... F41G 7/306 367/95
(Continued)

FOREIGN PATENT DOCUMENTS

DE 10 2004 062124 6/2006
JP S 57-196309 12/1982
(Continued)

*Primary Examiner* — Redhwan K Mawari
(74) *Attorney, Agent, or Firm* — Pearl Cohen Zedek Latzer Baratz LLP

(57) ABSTRACT

The invention relates to an underwater work system 1 with at least one autonomous unmanned underwater vehicle 2 and one unmanned relay vehicle 4 floating at the surface of the water 3, which comprises a radio antenna 5 for external communication 26 and a drive 16. The underwater vehicle 2 is connected to the relay vehicle 4 via an internal communication device.

The invention furthermore relates to a method for operating an underwater work system. In order to create an underwater work system with an autonomous underwater vehicle and an unmanned relay vehicle floating at the surface of the water as well as a method for operating such an underwater work system, which provides an increased efficiency of the autonomous underwater vehicle 2 with short mission times, it is provided according to the invention that the relay vehicle 4 is controllable by means of a control unit 16 via the at least one autonomous underwater vehicle 2 in due consideration of navigation information 17.

19 Claims, 2 Drawing Sheets

(51) Int. Cl.
*B63G 8/42* (2006.01)
*B63G 8/39* (2006.01)

(58) Field of Classification Search
CPC ..... H04B 11/00; H04N 13/0239; H04N 13/0296; H04N 2013/0081
USPC ..... 114/312; 348/E13.025
See application file for complete search history.

(56) References Cited

U.S. PATENT DOCUMENTS

| | | | | |
|---|---|---|---|---|
| 2002/0044202 | A1* | 4/2002 | Lee | H04N 13/0239 348/42 |
| 2009/0067289 | A1* | 3/2009 | Lee | H04B 11/00 367/87 |

FOREIGN PATENT DOCUMENTS

| | | |
|---|---|---|
| JP | 62-008895 | 1/1987 |
| WO | WO 91/13800 | 9/1991 |
| WO | WO 03/045776 | 6/2003 |
| WO | WO 2012/037174 | 3/2012 |

* cited by examiner

UNDERWATER WORKING SYSTEM AND METHOD FOR OPERATING AN UNDERWATER WORKING SYSTEM

CROSS-REFERENCE TO RELATED APPLICATIONS

This application is a National Phase Application of PCT International Application No. PCT/DE2013/100053, entitled "UNDERWATER WORKING SYSTEM AND METHOD FOR OPERATING AN UNDERWATER WORKING SYSTEM", International Filing Date Feb. 13, 2013, published on Oct. 3, 2013 as International Publication No. WO 2013/143528, which in turn claims priority from German Patent Application No. 10 2012 006 565.5, filed Mar. 30, 2012, both of which are incorporated herein by reference in their entirety.

FIELD OF THE INVENTION

The invention relates to an underwater work system with at least one autonomous underwater vehicle and an unmanned relay vehicle floating on the surface of the water.

BACKGROUND

Unmanned underwater vehicles offer a variety of possibilities for underwater works and can reach greater working depths compared to manned underwater vehicles and work in environments that are too dangerous for manned systems or divers. Autonomous underwater vehicles (AUV) have their own power supply and do not require communication with a human operator during their mission. They rather follow a prescribed mission program. Upon completion of the mission program, the autonomous underwater vehicle also submerges autonomously and is recovered for example by a mother ship.

The autonomous underwater vehicle is usually equipped with suitable sensors, such as sonar sensors. As opposed to remotely operated underwater vehicles (ROV="remotely operated vehicle"), which are adapted more specifically for missions with localized inspections, for example of concrete underwater objects, under real-time conditions, autonomous underwater vehicles are as a rule driven by a stern propeller and are more specifically adapted for extensive or large-scale reconnaissance under water. Autonomous underwater vehicles are for example advantageously used for cable and pipeline inspection or to search out mines.

During the mission of an autonomous unmanned underwater vehicle, recording the measurement results and if required transmitting them wirelessly to the mother ship is known. The transmission of information during the mission of the submerged underwater vehicle is however limited and only possible when the distance between the autonomous underwater vehicle and the mother ship is short.

In order to increase the range of data transmission to the mother ship, JP 62008895 A discloses an underwater working system for remote-controlled underwater vehicles (ROV), in which a supply and control cable of an unmanned remote-controlled underwater vehicle (ROV) is connected to a radio buoy floating at the surface of the water. The radio buoy is equipped with a radio antenna and a receiver and emitter unit. By way of the radio connection with the radio buoy and the supply cable between the radio buoy and the underwater vehicle, the underwater vehicle is remote-controllable by the mother ship.

By relaying the connection between the mother ship and the remote-controlled underwater vehicle via the radio buoy, the remote-controlled underwater vehicle can operate in its localized work space at a greater distance from the mother ship than would be possible with a direct connection of the underwater vehicle with the mother ship.

WO 91/13800 discloses a system for underwater reconnaissance with autonomous underwater vehicles having an identical configuration and comprising respectively one combustion motor and one electric motor as well as a battery. One of the underwater vehicles is located at the surface of the water, the combustion motor loading the battery. During this phase, the underwater vehicle located at the surface is in radio contact with a mother ship. The other underwater vehicle works under water and is driven by its electric motor. The two underwater vehicles communicate wirelessly via an acoustic or optical connection. As soon as the battery of the active submerged underwater vehicle is empty, the underwater vehicles change places. Images are transmitted via the wireless connection from the active underwater vehicle to the mother ship, namely first via the wireless connection with the surface underwater vehicle and subsequently via the radio connection of the surface underwater vehicle.

This known underwater work system is provided for local inspection of the underwater world, for example to explore a wreck. This known statically operating underwater work system is unsuitable for extensive underwater reconnaissance, for example for reconnoitering an underwater area in the context of mine clearance or for inspecting long pipelines.

WO 2012/037174 A2 discloses a buoy and a system for monitoring divers and other underwater objects. The buoy can monitor a diver and obtain position information about the diver and use that information in order to position itself accordingly for further monitoring.

The buoy can use an acoustic communication device for communication with the diver and determine the position of the diver as well as biometric and other data.

In one embodiment, the buoy comprises a drive system and the diver can guide the buoy to an operating area by way of an acoustic communication module.

A merely acoustic communication is mandatory since a possible physical connection, for example by means of a rope or hose, is not authorized for security reasons. In addition, the data transmission rate is limited by the acoustic communication, so that real-time capabilities cannot be ensured.

SUMMARY

The invention includes a method for operating an underwater work system, wherein at least one autonomous underwater vehicle communicates internally with an unmanned relay vehicle floating and propelled on the surface of the water and the relay vehicle communicates externally by way of a radio antenna.

The problem underlying the present invention is to create an underwater work system with at least one autonomous unmanned underwater vehicle and one unmanned relay vehicle floating on the surface of the water as well as a method for operating such an underwater work system, which provide an increased efficiency during extensive underwater reconnaissance with short mission times and a real-time capable data transmission.

The problem is solved by an underwater work system with at least one autonomous unmanned underwater vehicle and an unmanned relay vehicle floating on the surface of the water, which comprises a radio antenna for external communication and a drive, the autonomous unmanned underwater vehicle being physically connected with the relay vehicle by way of a coupling connection, this coupling connection including an internal communication device or the coupling connection being a part of the communication device, and the relay vehicle, the autonomous underwater vehicle and/or the coupling connection being configured in such a manner that the relay vehicle is guidable by means of a control unit via the autonomous underwater vehicle, more specifically in due consideration of navigation information.

Thus, data can be transmitted in two directions between the relay vehicle and the underwater vehicle with higher transmission rates than with an acoustic data transmission. A non-acoustic communication or data transmission can thus be provided.

It is more specifically possible to react quickly to suddenly occurring events caused for example by natural (e.g. fish) or technical objects (submarine) appearing in front of the underwater vehicle.

The underwater vehicle can additionally be supplied with power by way of the coupling connection.

The "coupling connection" physically connects the underwater vehicle with the relay vehicle. This coupling connection can also be implemented with a hose or a cable. The term "physically" must be more specifically understood in contrast to radio or sound.

In addition it is possible to physically take control of the underwater vehicle at any time, so that if the underwater vehicle is "lost", complex search operations by the relay vehicle can be omitted.

According to the invention, the unmanned relay vehicle floating at the surface of the water is guided by a control unit via the at least one autonomous unmanned underwater vehicle in due consideration of navigation information, so that the autonomous unmanned underwater vehicle can operate underwater with a virtually unlimited range.

The control unit can determine a course for the relay vehicle and can control its drive accordingly so that the vehicles of the underwater work system are always in a desired position relative to each other. The relay vehicle and the at least one associated underwater vehicle thus more specifically form an autonomous underwater work system which is navigated as an autonomous group. At the same time, the mission information captured by the sensors of the autonomous underwater vehicle during the mission is transmitted in real time to the relay vehicle, more specifically by the unmanned underwater vehicle.

Navigation information of the autonomous underwater vehicle must be understood as information on the performance and the position of the autonomous unmanned underwater vehicle, for example the absolute speed, the speed above ground, the orientation of the underwater vehicle, the diving depth and the distance from the relay vehicle and/or also sonar information.

In many mission-related situations the navigation information captured by the navigation sensors of the submerged autonomous underwater vehicle and supplied to the control unit is sufficient for a reliable guidance of the relay vehicle. Additional navigation information regarding the relay vehicle and the autonomous underwater vehicle can be captured by sensors on board the relay vehicle and used for navigation.

The control unit, which guides the relay vehicle, is advantageously disposed on board the relay vehicle, the navigation information captured by the submerged underwater vehicle being transmitted to the relay vehicle via the internal communication device.

However, guiding the relay vehicle by way of a control device disposed on board the autonomous underwater vehicle is also possible, control commands for driving the relay vehicle being channeled through the internal communication device. Disposing the control unit, which controls the relay vehicle, on board the relay vehicle is advantageous in that there is generally more available space on board the buoyant relay vehicle for an efficient control unit. Furthermore, by disposing energy consuming systems, which process information from and for the autonomous underwater vehicle, on board the relay vehicle, the energy requirement of the underwater vehicle is reduced.

If the underwater work system comprises several autonomous underwater vehicles, which are assigned to a common relay vehicle and are respectively connected via an internal communication device to the relay vehicle, the control unit considers the navigation information of all the involved underwater vehicles to calculate a course for the relay vehicle, which results in an optimal positioning of the relay vehicle relative to the connected underwater vehicles.

In one embodiment, the communication device is configured in such a manner that it is real-time capable. Real-time capability is more specifically given when the propagation speed of the transmission is greater than with acoustic communication. More specifically, propagation speeds of more than 2000 m per second are included. Real-time capability is more specifically ensured when sonar information is transmittable to the relay vehicle under the repetition rates of the sonar device.

In an advantageous embodiment of the invention, a control unit of the relay vehicle and a control unit of the autonomous underwater vehicle are configured in such a manner that navigation information for the relay vehicle and control commands for the underwater vehicle are exchangeable via the internal communication device. This way, the underwater work system according to the invention can be directly controlled in real time by a human operator, if required, while transmitting mission information.

The underwater work system with a constant transmission of information in both directions between the underwater vehicle and a support platform makes it possible to monitor the autonomously operating underwater work system, a control intervention by the operator being possible at any time ("supervised autonomous system"). The monitored autonomous underwater work system reduces mission times and increases the efficiency of the mission since an operator can recognize if the underwater vehicle has followed a wrong lead. In that case, a control intervention in the autonomous mission program prevents a loss of mission time that may result from continuing nonproductive inspections based on an error.

Information about the current position of the underwater vehicle is advantageously fed to it via the internal communication device. Reliable information about the position is available in the relay vehicle, which can obtain precise position data via its radio antenna, for example via GPS. This position of the relay vehicle obtained via GPS can be communicated to the autonomous underwater vehicle, so that the autonomous underwater vehicle navigates with the knowledge of the relay vehicle's position. Furthermore, a processing of the GPS data can occur on board the relay vehicle and, in due consideration of the navigation information of the underwater vehicle available in the relay vehicle, the exact position of the underwater vehicle can be transmitted to the underwater vehicle.

The internal communication device advantageously includes an optical fiber cable, which connects the relay vehicle to the underwater vehicle. The optical fiber cable allows for an efficient data transmission. The control unit of the relay vehicle guides the relay vehicle in due consideration of the navigation information of the autonomous underwater vehicle so that a tensile load on the optical fiber cable is avoided. Thereby, it can be advantageous if the control unit, which guides the relay vehicle, can access information about the tensile load on the optical fiber cable and controls the relay vehicle accordingly in case of an excessive tensile load. To this end, a device for measuring the tensile load can be attached to the optical fiber cable.

In an advantageous embodiment of the invention, the relay vehicle follows the underwater vehicle so that a tensile load on the optical fiber cable is reduced, respectively eliminated. The relay vehicle is for example steered along the same course as the underwater vehicle, the course of which results from the transmitted navigation information.

In an advantageous embodiment of the invention, the relay vehicle comprises means for determining the distance between the underwater vehicle and the relay vehicle. The relay vehicle is guided based on the navigation information of the underwater vehicle, which can be provided by the underwater vehicle during the mission, and on the current distance.

The actual position of the underwater vehicle can be clearly determined based on the navigation information of the underwater vehicle and the knowledge of the distance, and the course of the relay vehicle can be optimally synchronized; for example the relay vehicle can be guided along the same course. The distance between the underwater vehicle and the relay vehicle is advantageously captured by means of an acoustic emitter ("pinger"). To this end, the underwater vehicle and/or the relay vehicle comprise an acoustic emitter.

In an advantageous embodiment of the invention, navigation of the underwater vehicle is supported or taken over by the control unit of the relay vehicle, so that the required calculating capacity of the control unit on board the underwater vehicle and thus the power requirement of the underwater vehicle are reduced.

In another embodiment of the invention, the relay vehicle comprises a sonar device connected to its control unit, i.e. devices that are suitable for locating objects in space and underwater by means of emitted sound impulses. The control unit is configured in such a manner that evasive maneuvers are controllable when the sonar device detects obstacles.

The control unit of the relay vehicle recognizes obstacles in the course of the relay vehicle by way of the sonar and initiates evasive maneuvers, for example by laterally passing the obstacle. In a particularly advantageous embodiment, the relay vehicle is configured to be submersible, so that the relay vehicle can avoid a very wide object, for example a drifting net, by diving and passing under the obstacle, if necessary.

In another embodiment of the invention, the relay vehicle includes a data processing device into which information from the underwater vehicle can be entered. The data is pre-processed on board the relay vehicle before being transmitted to the support platform. In another embodiment of the invention, the relay vehicle includes an encoder, by means of which the information to be sent or received via the radio antenna is codable or decodable. The information, which the underwater vehicle internally transmits to the relay vehicle is pre-processed according to predefined data processing criteria before external communication.

In doing so, a selection of the data to be sent along the transmission path or a compression can for example be implemented. In addition, the information is protected along the transmission path by encoding.

The information that is not required or desired by an operator for monitoring the underwater vehicle, respectively the mission of the autonomous underwater vehicle is particularly advantageously stored on board the relay vehicle. This information can be readout after completion of the mission and recovery of the underwater vehicle and, in an advantageous embodiment, is kept ready for optional access via radio during the mission.

In addition, the problem can be solved by a method for operating an underwater work system, wherein at least one autonomous unmanned underwater vehicle internally communicates with an unmanned relay vehicle floating and propelled at the surface of the water, the relay vehicle communicating externally via a radio antenna, characterized in that a control unit guides the relay vehicle in due consideration of navigation information regarding the at least one autonomous unmanned underwater vehicle.

In an embodiment to this effect, the control unit guides the relay vehicle so that it follows the underwater vehicle.

The relay vehicle can additionally be guided based on the navigation information of the underwater vehicle and the current distance between the underwater vehicle and the relay vehicle, the distance being more specifically determined by means of an acoustic emitter on the underwater vehicle and/or on the relay vehicle.

In another embodiment, the navigation of the underwater vehicle is supported or taken over by a control unit of the relay vehicle.

In order to make the communication more effective, the information transmitted internally by the underwater vehicle to the relay vehicle can be pre-processed according to predefined criteria, and more specifically partially stored and partially sent.

In another embodiment, the control unit (16) of the relay vehicle (4) identifies obstacles (20) in the course of the relay vehicle (4) by way of a sonar device (19) and initiates an evasive maneuver by laterally passing the obstacle (20) and/or diving and passing under the obstacle (20).

BRIEF DESCRIPTION OF THE DRAWINGS

Further features of the invention can be gathered from the dependent claims as well as from the exemplary embodiments, which are described in more detail in the following based on the drawings. In the drawings:

DETAILED DESCRIPTION

Figure 1:
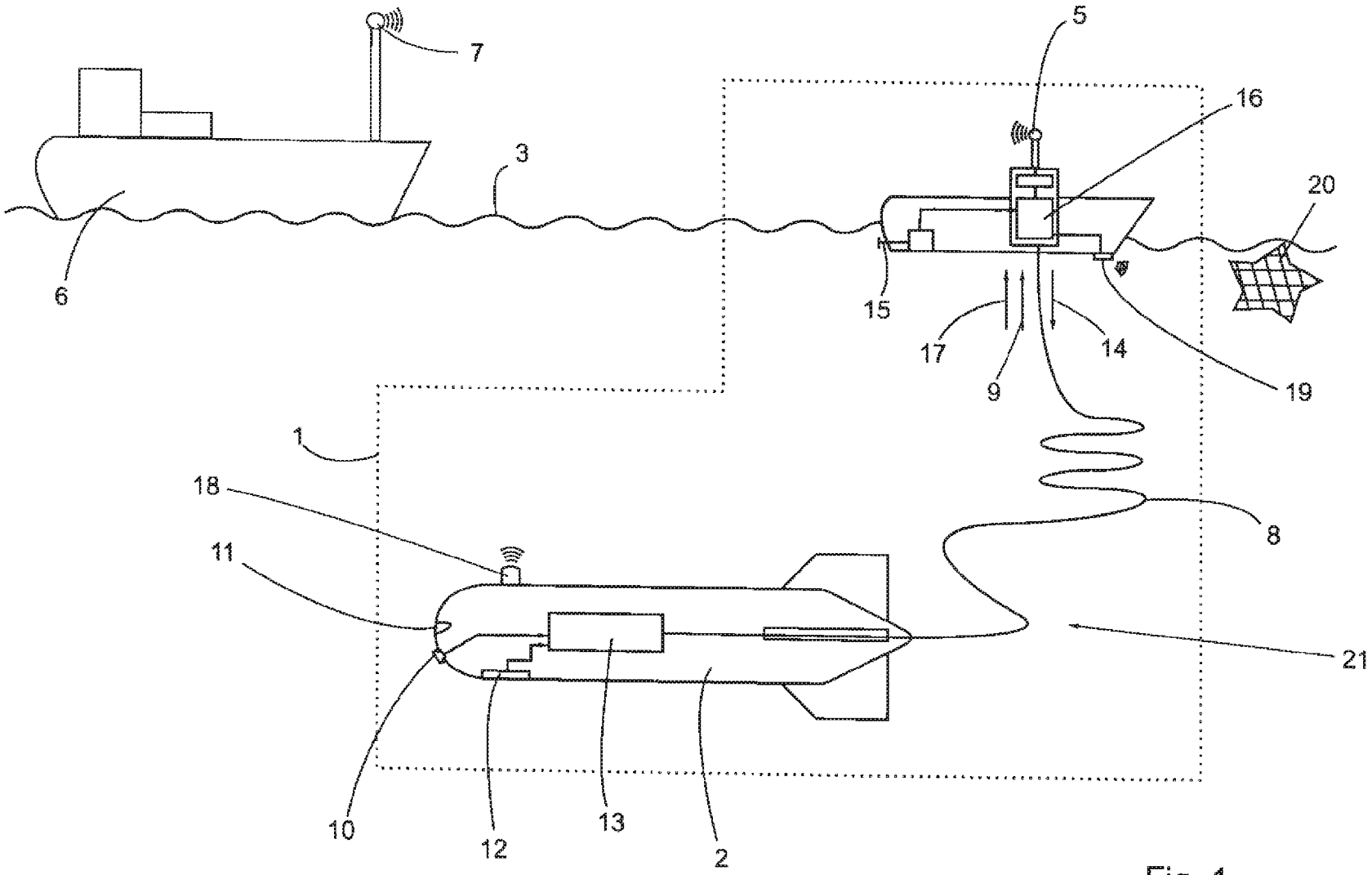
FIG. 1 shows an underwater work system with an autonomous underwater vehicle and an unmanned relay vehicle.

FIG. 1 shows an underwater work system 1 with an autonomous unmanned underwater vehicle 2 and an unmanned relay vehicle 4 floating at the surface of the water 3. The relay vehicle 4 comprises a radio antenna 5, by way of which the relay vehicle 4 communicates with a support platform. In the shown embodiment, the support platform is a seagoing vessel 6, which also carries a radio antenna 7 for communication with the underwater work system 1. Instead of a manned seagoing vessel 6, a control station on land or another manned support platform can also be provided, from which human operators can communicate with the underwater work system 1 via a radio link even at a great distance from the relay vehicle 4. The autonomous unmanned underwater vehicle 2 is connected to the relay vehicle 4 by way of an internal communication device, the term "internal" referring to communication within the underwater work system 1. The communication device comprises respectively one device for sending and receiving data on the relay vehicle 4 as well as on the underwater vehicle 2, as well as an optical fiber cable 8 in the exemplary embodiment. The optical fiber cable 8 connects the relay vehicle 4 with the underwater vehicle 2, respectively connects the devices for sending and receiving information disposed in the respective vehicles.

The relay vehicle 4 transmits a communication between the seagoing vessel and the submerged underwater vehicle 2 during the mission. In doing so, mission information 9 is transmitted during the mission in real time from the autonomously operating underwater vehicle 2 via the optical fiber cable 8 and the radio link between the relay vehicle 4 and the mother ship 6. The underwater vehicle 2 is equipped with a camera 10 and other sensors for surveying its environment, in the exemplary embodiment a sonar device 11, the continuously gathered data being transmitted as part of the mission information 9 via the optical fiber cable 8 to the relay vehicle 4. The underwater vehicle 2 further comprises navigation sensors 12, which are supplied to the control unit 13 of the underwater vehicle 2 and on which the autonomous navigation of the underwater vehicle 2 is based.

The autonomous unmanned underwater vehicle 2 follows a predetermined mission program and can independently operate underwater under guidance by its control unit 13. Via the radio antenna 5 of the relay vehicle 4, an operator of the underwater work system 1 can however supply control information 14, which is transferred by the relay vehicle 4 via the optical fiber cable 8, to the underwater vehicle 2. The underwater work system 1 can thus operate autonomously while being however constantly monitorable via the external communication with the seagoing vessel 6. Thus, an operator of the underwater work system can take over control of the unmanned underwater vehicle at any time. This is particularly advantageous if it turns out during monitoring of the underwater work system 1 that the underwater vehicle 2 has made an error based on the predefined autonomous mission program, for example has erroneously detected or identified and underwater object.

However, the control information 14 for the underwater vehicle 2 does not only include control commands given by the human operator but also other information, which is processed on board the relay vehicle 4 for use on the underwater vehicle, more specifically information for navigation. For example, a continuous transmission of position information, which is available on board the relay vehicle 4 and is very precisely determinable by GPS via the radio antenna 5, is advantageous.

The relay vehicle 4 is configured as a surface vessel in order to maintain constant radio contact with the support platform and comprises a drive 15. The relay vehicle 4 further comprises a control unit 16, which guides the relay vehicle 4 and controls the drive 15 according to the planned course and speed. When guiding the relay vehicle 4, the control unit 16 considers navigation information about the autonomous underwater vehicle 2, which is transmitted via the optical fiber cable 8 in the same direction as mission information 9 to the relay vehicle 4. In addition to the navigation information detected by the navigation sensors 12 on board the underwater vehicle 2, additional information about the underwater vehicle 2 can be detected by sensors on board the relay vehicle 4. In an advantageous embodiment, locating means are provided on board the relay vehicle 4 to this end.

In order to calculate a distance between the relay vehicle 4 and the underwater vehicle 2, an acoustic emitter 18, a so-called "pinger", is disposed on one of the two vehicles. In the shown embodiment, the acoustic emitter 18 is disposed on the unmanned underwater vehicle 2, so that the distance determination and the computer operations required for this can occur on board the relay vehicle 4. Thus it is not necessary to provide additional power, which is fundamentally limited on board the underwater vehicle, for distance determination on board the underwater vehicle 2. The relay vehicle 4 further comprises a sonar device 19 in the area of its bow, by means of which obstacles 20 drifting in the water can be detected in time. If an obstacle is detected in the course of the relay vehicle 4 during processing of the signals of the sonar device 19, the control unit 16 initiates a corresponding evasive maneuver by laterally passing the obstacle or causes the relay vehicle 4 to dive and pass under the obstacle 20. To this end, in the shown exemplary embodiment, the relay vehicle 4 is designed for short-term diving maneuvers. In another exemplary embodiment, the relay vehicle 4 is an underwater vehicle, which is used as relay vehicle 4 at the surface of the water 3. By passing under the obstacle 20, the destruction of the damageable optical fiber cable 8 by broad obstacles drifting under water such as nets and the like can be prevented. After passing under the obstacle 20, the relay vehicle 4 immediately surfaces and resumes radio contact with the seagoing vessel 6.

is an underwater vehicle, which is used as relay vehicle 4 at the surface of the water 3. By passing under the obstacle 20, the destruction of the damageable optical fiber cable 8 by broad obstacles drifting under water such as nets and the like can be prevented. After passing under the obstacle 20, the relay vehicle 4 immediately surfaces and resumes radio contact with the seagoing vessel 6.

The control unit 16 determines the course of the relay vehicle 4 after processing the navigation information of the unmanned underwater vehicle in such a manner that the distance between both vehicles does not exceed predefined limit values. The control unit 16 thus determines the course of the relay vehicle 4 in such a manner that the relay vehicle 4 follows the underwater vehicle 2. If, during determination of the distance, too great a distance is determined between the relay vehicle 4 and the underwater vehicle 2, the control unit calculates a new course along which the relay vehicle 4 is sent after the underwater vehicle 2. The underwater vehicle 2 can thus operate autonomously, the relay vehicle 4 following it at the surface of the water 3 and maintaining constant external communication of the underwater work system 1 with the seagoing vessel 6.

Figure 2:
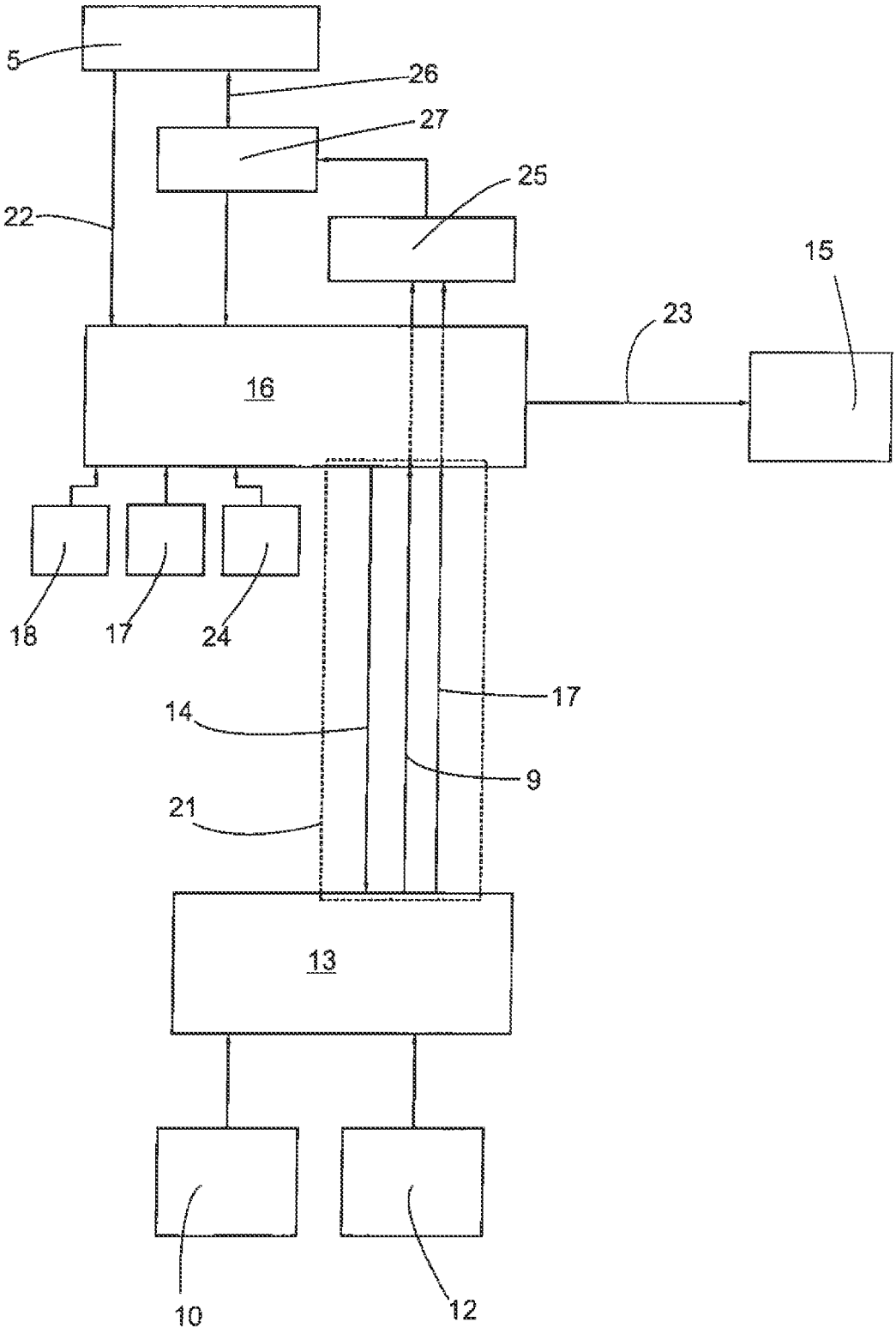
FIG. 2 shows a diagram for communication between the relay vehicle and the unmanned underwater vehicle according to FIG. 1.

The internal communication between the control unit of the relay vehicle 4 and the control unit 13 of the autonomous unmanned underwater vehicle 2 including the external communication via the relay vehicle 4 is explained in more detail in the following based on FIG. 2. Mission information 9, which is recorded during the mission by the camera 10 and other sensors in order to detect the environment, is transmitted by the control unit 13 of the underwater vehicle 2 via the internal communication device 21, which includes the optical fiber cable 8 according to FIG. 1. Together with the mission information 9 transmitted in real-time, the control unit 13 transmits mission information 17 about the autonomous underwater vehicle 2 to the control unit 16 of the relay vehicle 4. The navigation information 17 can include raw data of the navigation sensors 12 of the underwater vehicle 2 as well as already processed navigation information based on the raw data of the navigation sensors 12, which is available to the control unit 13 of the underwater vehicle 2 for its own autonomous navigation during the mission. Depending on the configuration of the underwater work system 1, the navigation information 17 transmitted to the relay vehicle can also be a combination of raw data and of navigation information already determined in the underwater vehicle based on the raw data. The control unit 13 of the underwater vehicle 2 is particularly advantageously connected to the control unit 16 of the relay vehicle 4 in such a manner that the navigation of the underwater vehicle 2 is supported or taken over by the control unit 16 of the relay vehicle 4. The navigation information, respectively the measured values captured by the navigation sensors is directly transmitted from the underwater vehicle 2 to the control unit 16 of the relay vehicle 4. After processing the received navigation information 17, the control unit 16 of the relay vehicle 4 feeds corresponding control information 14 to the control unit 13 of the underwater vehicle 2.

When the operator on board the seagoing vessel 6 takes over control or wants to transmit other commands to the underwater vehicle 2, the relay vehicle 4 receives the corresponding commands via the radio link and transmits corresponding control information 14 to the control unit 13 of the underwater vehicle 2.

Based on an analysis of the pinger signal of the acoustic emitter 18 (FIG. 1) of the underwater vehicle 2, the control unit 16 determines the distance between the underwater vehicle 2 and the relay vehicle 4. Knowledge of the precise distance gives the exact position of the underwater vehicle 2 relative to the relay vehicle 4. The control unit 16 of the relay vehicle 4 further receives GPS position signals 22 via the radio antenna 5, so that the control unit 16 can precisely determine the actual position of the relay vehicle 4. By combining the actual position of the relay vehicle with the relative position of the underwater vehicle, the actual position of the underwater vehicle is calculated and is provided to the underwater vehicle as part of the control information 14. Thus, in the course of the mission program, the autonomous navigation of the underwater vehicle can access the exact position of the underwater vehicle, which the autonomous underwater vehicle cannot reliably determine during its mission under water.

If the control unit 16 of the relay vehicle detects too great a distance between the relay vehicle 4 and the underwater vehicle 2, a course correction is carried out, in order to send the relay vehicle 4 after the underwater vehicle 2. The control unit 16 calculates corresponding control commands 23 for the drive 15 of the relay vehicle 4. During navigation of the relay vehicle 4, the control unit 16 considers the incoming measured values of the sonar device 19 of the relay vehicle 4, evasive maneuvers being initiated if necessary in case of obstacles 20 ahead. In order to improve navigation precision, other navigation sensors 24 are disposed in the relay vehicle 4, which provide additional information to the control unit 16 during guidance of the relay vehicle 4. A data processing device 25 is assigned to the control unit 16 of the relay vehicle 4, in which information destined for external communication 26 is preprocessed. In doing so, a selection of the information desired for external communication 26 can occur; for example, only mission information 9 can be transmitted in real time. The data processing device can furthermore be used for storage of information, so that corresponding devices on board the underwater vehicle 2 are not required and the power supply of the underwater vehicle 2 is relieved.

In the shown exemplary embodiment, the external communication 26 occurs via an encoder 27, which encodes the information destined for external communication 26, respectively decodes the information received via the antenna and makes it available to the control unit 6. That way, it is ensured that during external communication 26 of the underwater work system via the radio antenna 5, the transmitted information is encoded. All the features mentioned in above description of the figures, in the claims and in the introduction to the description are implementable individually as well as in any combination of each other. Therefore, the disclosure of the invention is not limited to the described to the described or claimed feature combinations. Any combination of features must rather be considered as disclosed.

The invention claimed is:

1. An underwater work system comprising at least one unmanned underwater vehicle and one unmanned relay vehicle floating at the surface of the water, which comprises a drive and a control unit, the unmanned underwater vehicle being physically connected to the relay vehicle via a coupling connection, the coupling connection including or being part of an internal communication device, and the relay vehicle, the underwater vehicle and/or the coupling connection being configured in such a manner that navigation information is captured by the underwater vehicle and transmitted to the relay vehicle through the coupling connection and the relay vehicle is guidable by a control unit of the relay vehicle via the underwater vehicle using said navigation information.

2. The underwater work system according to claim 1, wherein the internal communication device is designed in such a manner that it is real-time capable.

3. The underwater work system according to claim 1 wherein said control unit controls the relay vehicle the system further comprising a control unit for the unmanned underwater vehicle, the control units being configured in such a manner that navigation information for the relay vehicle and control information for the unmanned underwater vehicle is exchangeable via the internal communication device.

4. The underwater work system according to claim 1 wherein the coupling connection occurs by way of an optical fiber cable, which physically connects the relay vehicle to the unmanned underwater vehicle.

5. The underwater work system according to claim 1, wherein the relay vehicle and/or the unmanned underwater vehicle comprise means for determining the distance between the unmanned underwater vehicle and the relay vehicle.

6. The underwater work system according to claim 1, wherein the unmanned underwater vehicle and/or the relay vehicle comprise an acoustic emitter.

7. The underwater work system according to claim 1, wherein the relay vehicle and/or the unmanned underwater vehicle comprise a sonar device, the relay vehicle and/or the underwater vehicle being more specifically configured in such a manner that when the sonar device detects obstacles, evasive maneuvers of the unmanned underwater vehicle and/or the relay vehicle are controllable.

8. The underwater work system according to claim 1, wherein the relay vehicle is designed to be submersible.

9. The underwater work system according to claim 1, wherein the relay vehicle includes a data processing device, into which information from the underwater vehicle can be input.

10. The underwater work system according to claim 1, wherein the relay vehicle includes a radio for external communication and an encoder, by means of which information to be sent or received by the radio antenna is encodable or decodable.

11. A method of operating an underwater work system comprising at least one unmanned underwater vehicle communicating with an unmanned relay vehicle floating and propelled at the surface of the water, the method comprising capturing by the underwater vehicle navigation information including the position of the underwater vehicle, transmitting said navigation information from the underwater vehicle to the relay vehicle through a coupling connection and guiding the relay vehicle by means of a control unit based on said navigation information from the at least one unmanned underwater vehicle so that said relay vehicle is steered along the same course as the underwater vehicle.

12. The method of claim 11 wherein the guiding of the relay vehicle is based on the current distance between the underwater vehicle and the relay vehicle.

13. The method of claim 12 comprising determining the current distance by means of an acoustic emitter on one or both of the underwater vehicle and the relay vehicle.

14. The method of claim 11 comprising determining a course for the relay vehicle and controlling the drive of the relay vehicle accordingly by means of the control unit so that the vehicles of the underwater work system are always in a desired position relative to each other.

15. The method of claim 11 comprising supplying to the control unit navigation information captured by navigation sensors of the underwater vehicle.

16. The method of claim 11 comprising identifying an obstacle in the course of the relay vehicle and initiating by means of the control unit an evasive maneuver by laterally passing the obstacle and/or diving and passing under the obstacle.

17. The method of claim 16 in which the evasive maneuver is performed by one of the relay vehicle and the underwater vehicle and the control of the evasive maneuver is via the other of the relay vehicle and the underwater vehicle.

18. The method of claim 11 wherein the system comprises multiple underwater vehicles assigned to the relay vehicle and the method comprises calculating a course for the relay vehicle based on navigation information from all of the multiple underwater vehicles.

19. An underwater work system comprising at least one unmanned underwater vehicle, an unmanned relay vehicle comprising a control unit floating and propelled at the surface of the water, the underwater vehicle communicating internally with and being physically connected to the unmanned relay vehicle such that navigation information including the position of the underwater vehicle is transmitted to the relay vehicle, and a control unit configured to guide the relay vehicle based on navigation information from the at least one unmanned underwater vehicle to steer the relay vehicle along the same course as the underwater vehicle.

* * * * *